US007210678B2

(12) United States Patent
Deshimaru et al.

(10) Patent No.: US 7,210,678 B2
(45) Date of Patent: May 1, 2007

(54) SHEET CONVEYING DEVICE

(75) Inventors: Teruo Deshimaru, Nagoya (JP); Tomohisa Higuchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 517 days.

(21) Appl. No.: 10/671,510

(22) Filed: Sep. 29, 2003

(65) Prior Publication Data

US 2004/0070143 A1 Apr. 15, 2004

(30) Foreign Application Priority Data

Sep. 30, 2002 (JP) ..... 2002-286441

(51) Int. Cl.
*B65H 3/06* (2006.01)

(52) U.S. Cl. ..... 271/109; 271/272

(58) Field of Classification Search ..... 271/272, 271/264, 273, 274, 109
See application file for complete search history.

(56) References Cited

U.S. PATENT DOCUMENTS

| | | | | |
|---|---|---|---|---|
| 3,428,308 | A * | 2/1969 | Bernard | 271/273 |
| 5,152,522 | A * | 10/1992 | Yamashita | 271/264 |
| 5,533,822 | A | 7/1996 | Tsukada et al. | |
| 5,738,455 | A | 4/1998 | Umeda | |
| 5,975,523 | A * | 11/1999 | Suzuki | 271/242 |

FOREIGN PATENT DOCUMENTS

| | | |
|---|---|---|
| JP | U 61-47653 | 3/1986 |
| JP | A 63-272733 | 11/1988 |
| JP | U 63-192041 | 12/1988 |
| JP | A-1-178961 | 7/1989 |
| JP | A-2-123050 | 5/1990 |
| JP | U-2-72249 | 6/1990 |
| JP | A 5-96799 | 4/1993 |
| JP | A-5-139566 | 6/1993 |
| JP | A 9-100046 | 4/1997 |
| JP | A 9-142691 | 6/1997 |
| JP | A-9-221248 | 8/1997 |
| JP | A 9-240091 | 9/1997 |
| JP | A 10-235955 | 9/1998 |
| JP | A 10-250870 | 9/1998 |
| JP | A 11-11730 | 1/1999 |
| JP | A 11-314789 | 11/1999 |
| JP | A 2000-136046 | 5/2000 |
| JP | A-2001-106407 | 4/2001 |

* cited by examiner

*Primary Examiner*—David H. Bollinger
(74) *Attorney, Agent, or Firm*—Oliff & Berridge, PLC

(57) ABSTRACT

A sheet conveying device includes a metal feed roller driven by a drive source and a plastic pinch roller pressed against the feed roller. A sheet is held between the feed roller and the pinch roller, to convey the sheet to a recording unit. An elastic ring having a high wear resistance is fitted over a part of an outer surface of the pinch roller in a width direction of the pinch roller. Accordingly, the elastic deformation of the elastic ring reduces or absorbs load (impact) that causes a rear end of the sheet to flick or spring and the improper sheet feeding, when the rear end of the sheet passes through a nip portion between the feed roller and the pinch roller. Thus, variances in the sheet feeding amounts and the poor image formation are prevented.

14 Claims, 11 Drawing Sheets

SHEET CONVEYING DEVICE

BACKGROUND OF THE INVENTION

1. Field of Invention

The invention relates to a sheet conveying device, for use in an image forming apparatus, that conveys sheets to a recording unit, by holding the sheets between a feed roller and a pinch roller.

2. Description of Related Art

Printing devices, such as ink jet printers, are provided with sheet conveying devices for conveying sheets mounted on a sheet cassette one by one to a recording or printing unit. The sheet conveying device includes a metal feed roller that is driven by a drive source to rotate, and a plastic pinch roller pressed against the feed roller. The sheet is held between the feed roller and the pinch roller and conveyed to the recording unit.

To increase a printing accuracy of the printing devices, an accuracy of a sheet conveyance with the sheet conveying device needs to be increased. Especially, the ink jet printers that perform printing in high dot density, require the higher sheet conveying accuracy.

To increase an accuracy of a sheet conveying speed, the pinch roller and the feed roller of the sheet conveying device need to be firmly and uniformly pressed against each other to prevent improper sheet feeding. To achieve this, for example, Japanese Laid Open Patent Publication No. 9-142691 discloses a plurality of roller holders that rotatably support the pinch roller at one end thereof and springs that urges the roller holder at rear side ends thereof.

Recently, a margin at an end of the sheet tends to be reduced, so that distance between a printing portion and a nip portion between the feed roller and the pinch roller need to be reduced.

However, reduction of the distance between the printing portion and the nip portion is physically limited. As the distance between the printing portion and the nip portion becomes shorter, the pinch roller needs to be supported to press the feed roller firmly. In the sheet conveying device having the pinch roller and the feed roller pressed firmly against each other, a rear end of the sheet being conveyed flicks or springs due to an impact applied when the rear end of the sheet passes through the nip portion between the pinch roller and the feed roller. This causes improper sheet feeding or variances in sheet feeding amounts, resulting in poor image formation.

SUMMARY OF THE INVENTION

Accordingly, one aspect of the invention is to provide a sheet conveying device that prevents a poor image formation by prevent improper sheet feeding and by minimizing variances of sheet feeding amounts.

A sheet conveying device for use in an image forming apparatus, according to the invention may hold a sheet and convey the sheet to a recording unit. The sheet conveying device may include a pair of rollers that includes a feed roller driven by a drive source and a pinch roller pressed against the feed roller, an elastic ring that is fitted over at least one of the feed roller and the pinch roller, partially in a width direction thereof, on an outer surface thereof, and a guide film that guides the sheet, the guide film extending from an upstream of the roller pair in a sheet conveying direction toward a nip portion between the pinch roller and the feed roller, without contacting the elastic ring fitted over the roller pair.

The feed roller driven by the drive source may be made of metal. The pinch roller pressed against the feed roller may be made of resin. The pinch roller may fit thereover partially in the width direction thereof the elastic ring, on the outer surface of the pinch roller. The guide film disposed on the roller holder for guiding the sheet may extend from the upstream of the pinch roller in the sheet conveying direction toward the nip portion between the pinch roller and the feed roller, without contacting the elastic ring fitted over the pinch roller.

According to the invention, elastic deformation of the elastic ring fitted over the roller pair may reduce or absorb load (impact) that causes a rear end of the sheet to flick or spring and the improper sheet feeding, when the rear end of the sheet passes through the nip portion between the feed roller and the pinch roller. Thus, variances in the sheet feeding amounts and the poor image formation may be prevented.

When the feed roller and the pinch roller are reversely rotated for sheet registration, a leading end of the sheet may be prevented from contacting the elastic ring with the leading end being lifted, and the sheet may be favorably conveyed near the nip portion between the feed roller and the pinch roller, with the guide film. Therefore, poor sheet feeding such that the sheet end is turned up by the elastic ring while the feed roller and the pinch rollers are reversely rotated, may be prevented.

BRIEF DESCRIPTION OF THE DRAWINGS

An embodiment of the invention will be described in detail with reference to the following figures wherein.

DETAILED DESCRIPTION OF PREFERRED EMBODIMENTS

Figure 1:
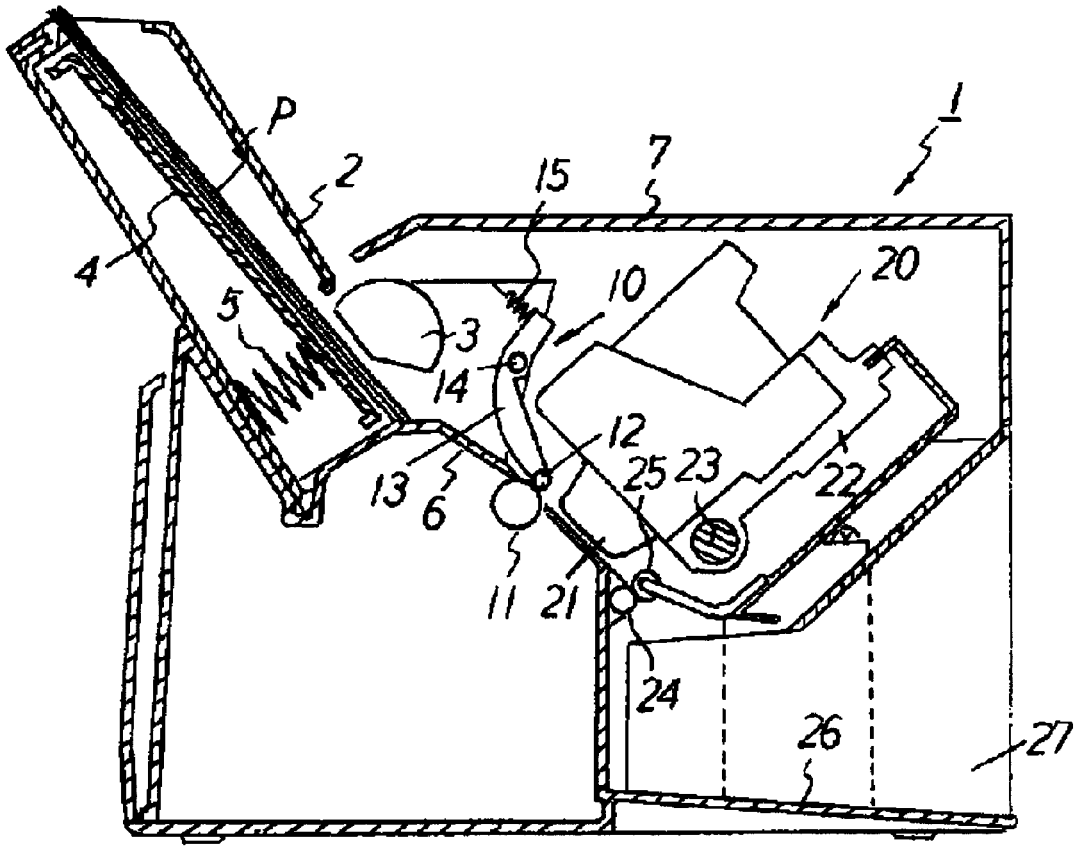
FIG. 1 is a cross sectional view of an ink jet printer including a sheet conveying device according to an embodiment of the invention.

An ink jet printer 1 including a sheet conveying device 10 according to an embodiment of the invention will be described with reference to FIG. 1. As shown in FIG. 1, the ink jet printer 1 is provided at a rear side thereof (left side in FIG. 1) with a sheet feeder 2 capable of mounting a plurality of sheets P thereon. A pick-up roller 3 is disposed on a lower front side of the sheet feeder 2 at a position to contact the uppermost sheet P. The pick-up roller 3 is supported by a rotating shaft disposed along the width direction of the sheet P.

The sheet feeder 2 includes a tray 4 on which sheets P are mounted. The tray 4 is urged by a spring 5 toward the pick-up roller 3. Therefore, the uppermost sheet P on the tray 4 contacts the surface of the pick-up roller 3 by the urging force of the spring 5. The uppermost sheet P is separated by the pick-up roller 3 driven by a motor (not shown), and fed along a guide 6 in a sheet feeding direction (in a slanting downward direction).

The sheet conveying device 10 is disposed in a downward slanting direction of the pick-up roller 3 inside a cover frame 7. The sheet conveying device 10 includes a feed roller 11 that is driven by a motor (not shown) to rotate, and a pinch roller 12 that is pressed against the feed roller 11. The feed roller 11 is a metal roller having ceramic coating on the outer surface thereof.

The pinch roller 12 is rotatably supported at an end (lower end) of a roller holder 13. The roller holder 13 is supported so as to pivot about a pivot 14 provided at substantially a central portion thereof. The roller holder 13 is urged in the clockwise direction in FIG. 1 by a spring (coil spring) 15, so that the pinch roller 12 and the feed roller 11 can be pressed against each other with a certain pressure. Accordingly, the sheet P fed by the pick-up roller 3 along the guide 6 is sandwiched at a nip portion between the feed roller 11 and the pinch roller 12 and fed in the sheet feeding direction toward the downward slanting direction.

A printing unit 20 is provided downstream of the sheet conveying device 10 in the sheet feeding direction. The printing unit 20 includes a print head 21 disposed so as to face a surface of the sheet P conveyed by the sheet conveying device 10. The print head 21 includes a plurality of ink chambers attached to piezoelectric elements (not shown). Application of voltage to the piezoelectric elements causes the volumetric capacity of the ink chambers to change. Accordingly, the ink is ejected onto the sheet P from nozzles (not shown) formed with the ink chambers. The print head 21 is not limited to print heads having the piezoelectric elements in association with ink chambers, but so-called thermal ink-jet print heads having heating elements may be used.

The print head 21 is mounted on the carriage 22. The carriage 22 is slidably supported by a guide shaft 23 that is disposed along a lateral direction of the printer 1.

The carriage 22 is reciprocated by a drive motor (not shown) along the guide shaft 23. The print head 21 mounted on the carriage 22 moves in the lateral direction to perform printing onto the sheet P.

Provided below the print head 21 are a discharge roller 24 that is driven by a motor (not shown) so as to rotate and a presser roller 25 that holds the printed sheet P in cooperation with the discharge roller 24 for discharging the sheet P. A discharge tray 27 that receives the discharged sheets P is disposed on a base frame 26.

Figure 2:
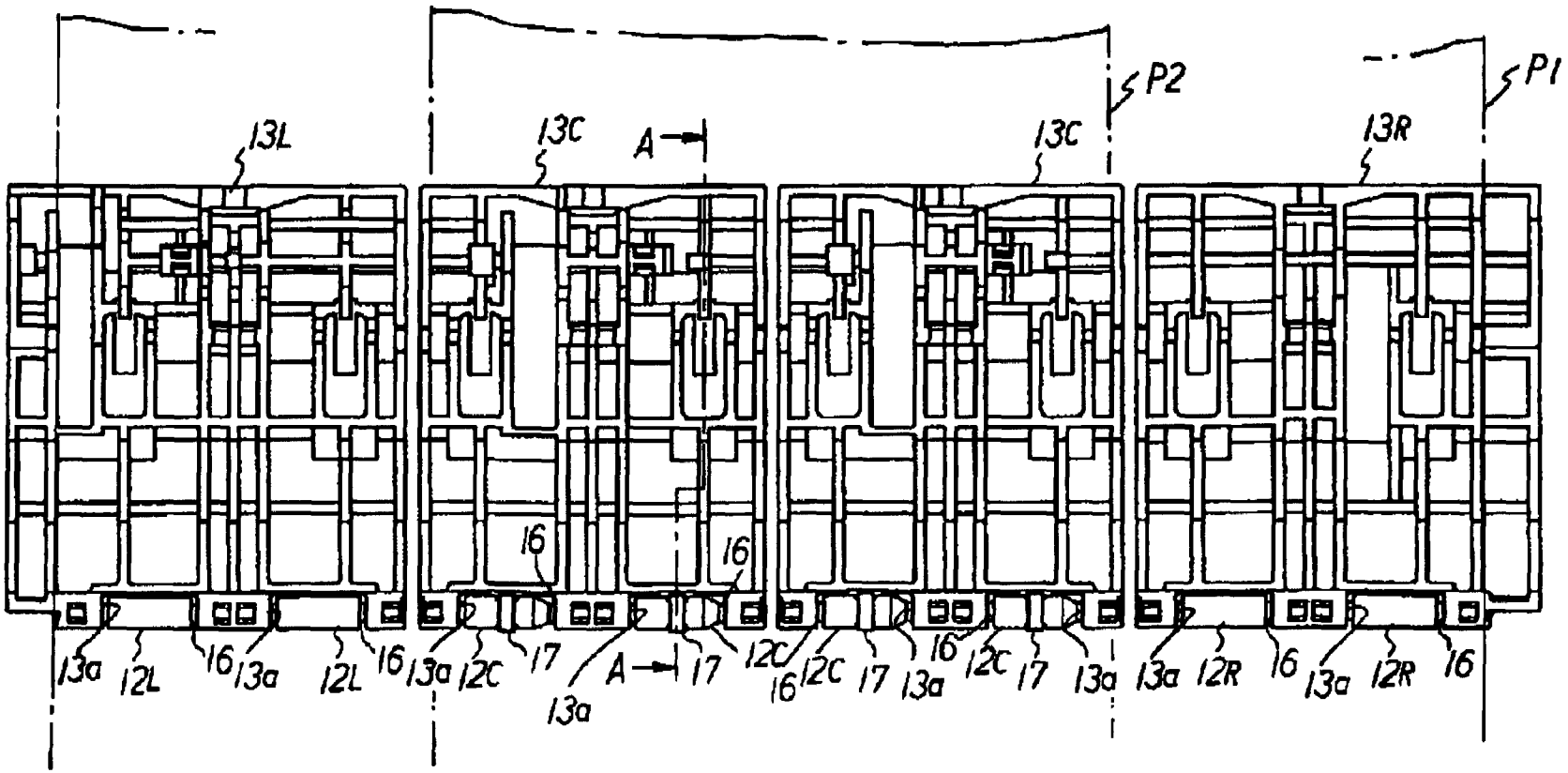
FIG. 2 is a plan view of a roller holder of the sheet conveying device.

In the sheet conveying device 10, the roller holder 13 is made up of four roller holders, that is, a left roller holder 13L, a right roller holder 13R, and two central roller holders 13C, that are disposed in the width direction of the printer 1, as shown in FIG. 2. The difference between the central roller holder 13C and the right and left roller holders 13R, 13L is that the right and left roller holders 13R, 13L have an extended right end portion and an extended left end portion, respectively. As described above, the roller holder 13 made up of four holders 13L, 13C, 13C, 13R is pivotally and independently supported by the metal pivot 14 disposed at a substantially central portion of the roller holder 13, as shown in FIG. 1.

Figure 3:
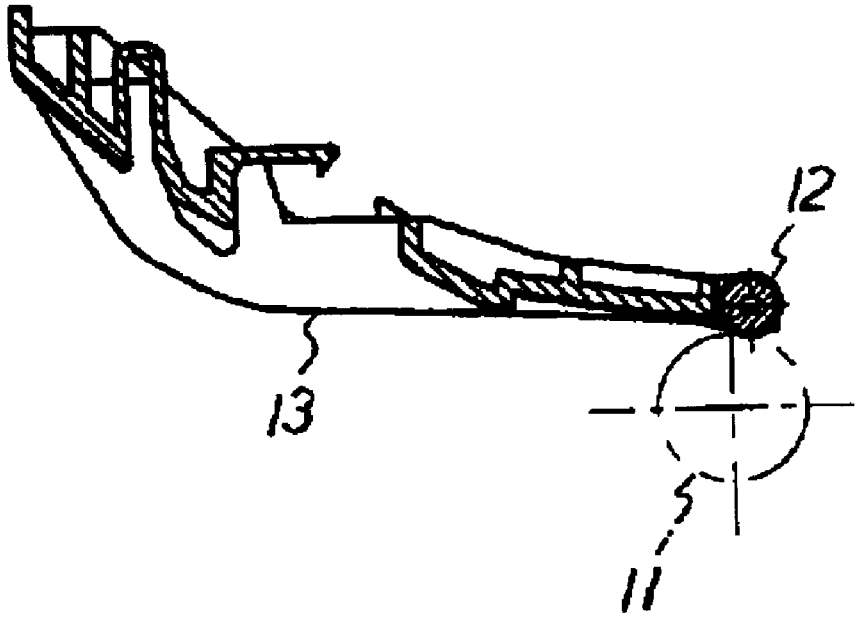
FIG. 3 is a cross sectional view of the roller holder taken along the line A—A of FIG. 2.
Figure 7:
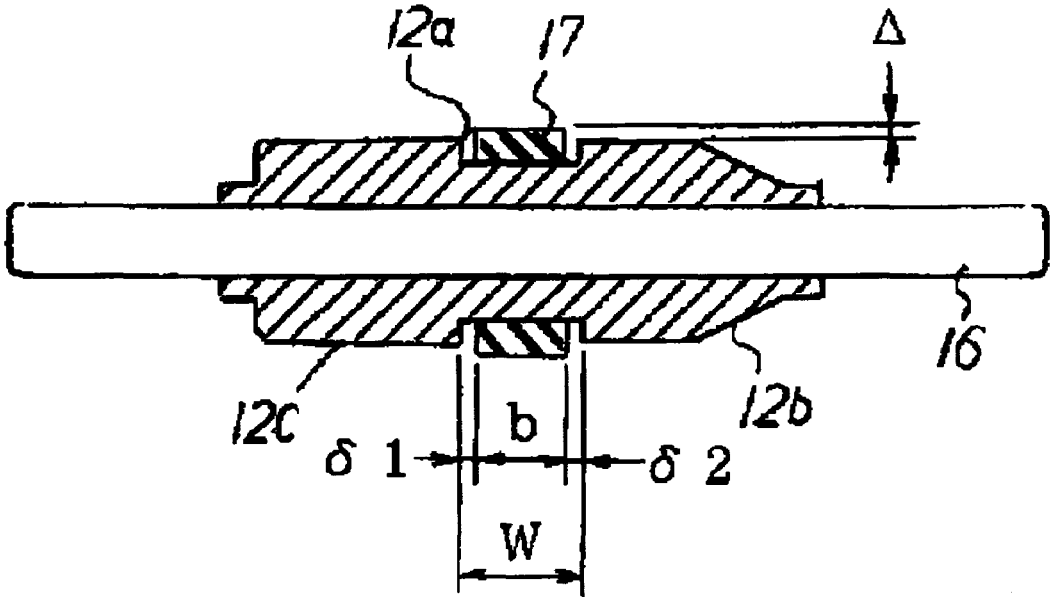
FIG. 7 is a cross sectional view of the pinch roller with the elastic ring fitted thereover.

The roller holder 13 is integrally formed of resin material into a substantially "L" shape, as shown in FIGS. 1 and 3. The pinch roller 12 is rotatably supported at a lower end of the roller holder 13 and disposed on the right and left side of each roller holder 13L, 13C, 13R. As shown in FIG. 2, each roller holder 13L, 13C 13R has substantially rectangular recesses 13*a* on the lower right and left sides thereof. The pinch roller 12 is rotatably supported in the recess 13*a* by a metal roller pin 16 that passes through the pinch roller 12, as shown in FIG. 7. The pinch roller 12 consists of a left pinch roller 12L for use in the left roller holder 13L, a right pinch roller 12R for use in the right roller holder 13R, and a central pinch roller 12C for use in the central roller holder 13C. Except for the pinch roller 12C, the right and left pinch rollers 12R, 12L have the same structures. The differences between the left and right pinch rollers 12L, 12R and the central pinch roller 12C will be described below.

Figure 5:
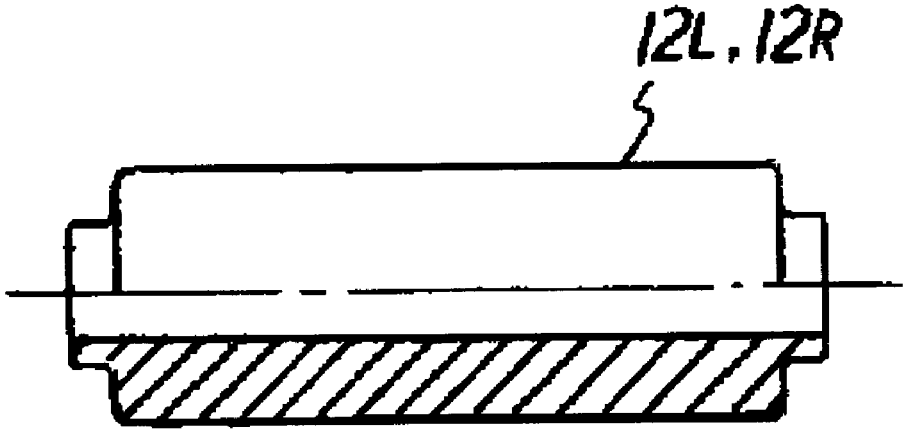
FIG. 5 is a half-cut view of a pinch roller.
Figure 6:
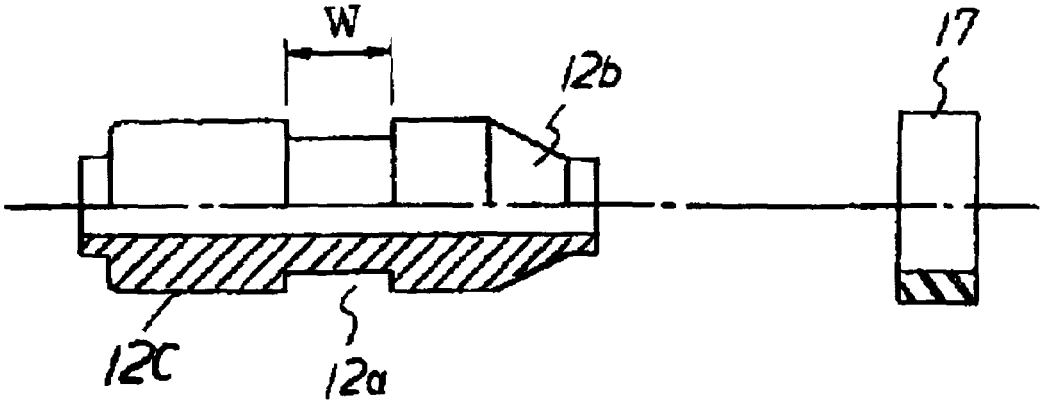
FIG. 6 is a half-cut view of the pinch roller and an elastic ring.

As shown in FIG. 5, the left and right pinch roller 12L, 12R is formed of resin material, such as polyacetal, into a substantially cylindrical shape. Similarly, the central pinch roller 12C for use in the central roller holder 13C is formed of resin material, such as polyacetal. However, a groove 12*a* having a width W is formed on an outer surface of the central pinch roller 12C at a substantially central portion in the width direction thereof, as shown in FIG. 6. The pinch roller 12C has a tapered surface 12*b* at an end thereof that is gradually narrowed down toward an axial direction.

An elastic ring 17 that is fitted over the pinch roller 12C is made of thermoplastic fluororubber having a high wear or abrasion resistance. A tube of the thermoplastic fluororubber is cut into pieces to have the width b, as shown in FIG. 7. The width b is set to 1 mm or greater to provide a sufficient strength for the elastic ring 17 and to increase the durability. The thermoplastic fluororubber tube that may be used as an ink tube is used for the elastic ring 17 by cutting the tube into pieces having the width b. Accordingly, the elastic ring 17 has a high resistance to ink. Even if the ink from the print head 21 should be adhered to the elastic ring 17, the elastic ring 17 will not be corroded by the ink, maintaining its quality over the long term.

As shown in FIG. 7, the elastic ring 17 is fixedly fitted into the groove 12*a* formed on the outer surface of the central pinch roller 12C. The elastic ring 17 can be readily inserted over the pinch roller 12C, if the ring 17 is inserted into the groove 12*a* along the tapered surface 12*b* serving as a guide. Thus, the ease of assembly is increased. As the ring 17 is fixedly fixed into the groove 12*a*, the ring 17 does not come off the pinch roller 12C. Accordingly, the operation of the sheet conveying device 10 is highly stabilized.

The friction coefficient of the pinch roller 12 and the elastic ring 17 were actually measured. The friction coefficient of the plastic pinch roller 12L, 12R alone on its surface was 0.3. The friction coefficient of the elastic ring 17 alone on its surface was 0.6. The average friction coefficient of the pinch roller 12C in combination with the elastic ring 17 on their surface was 0.4 to 0.47.

Figure 8:
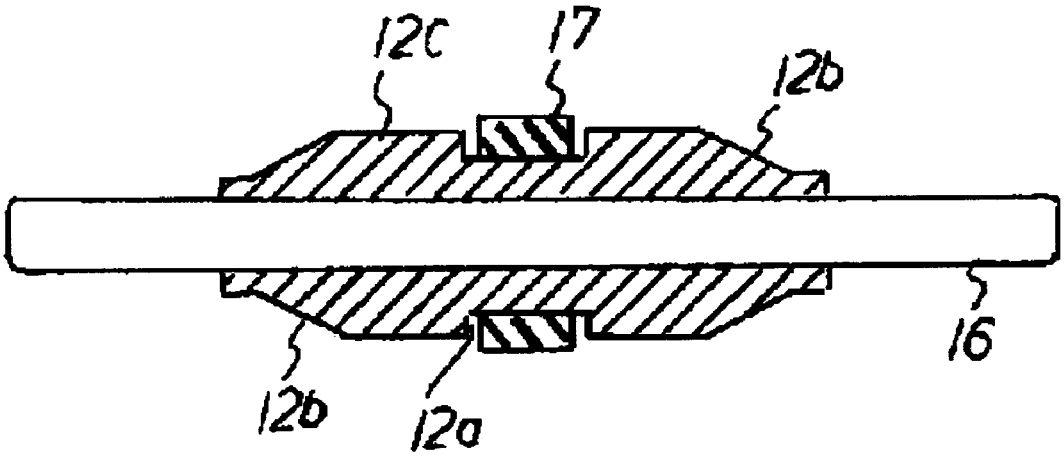
FIG. 8 is a cross sectional view of the pinch roller with the elastic ring fitted thereover according to a modification of the embodiment of the invention.

As shown in FIG. 8, the pinch roller 18 may have the tapered surface 12*b* on each end of the pinch roller 12C in the axial direction. With this structure, the elastic ring 17 can be fitted over the pinch roller 12C from either end of the pinch roller 12C. Thus, the assembly of the elastic ring 17 and the pinch roller 12C can be performed more easily.

As shown in FIG. 7, the width W of the groove 12*a* of the pinch roller 12C is wider than the width b of the elastic ring 17, so that clearances δ1, δ2 are set between an end of the groove 12*a* and an end of the elastic ring 17. The clearances δ1, δ2 will be described in more detail below.

The outside diameter of the elastic ring 17 is set greater than that of the pinch roller 12C. The projection Δ of the elastic ring 17 from the outer surface of the pinch roller 12C is set to approximately 0.2 to 0.5 mm, preferably 0.3 mm.

Figure 4:
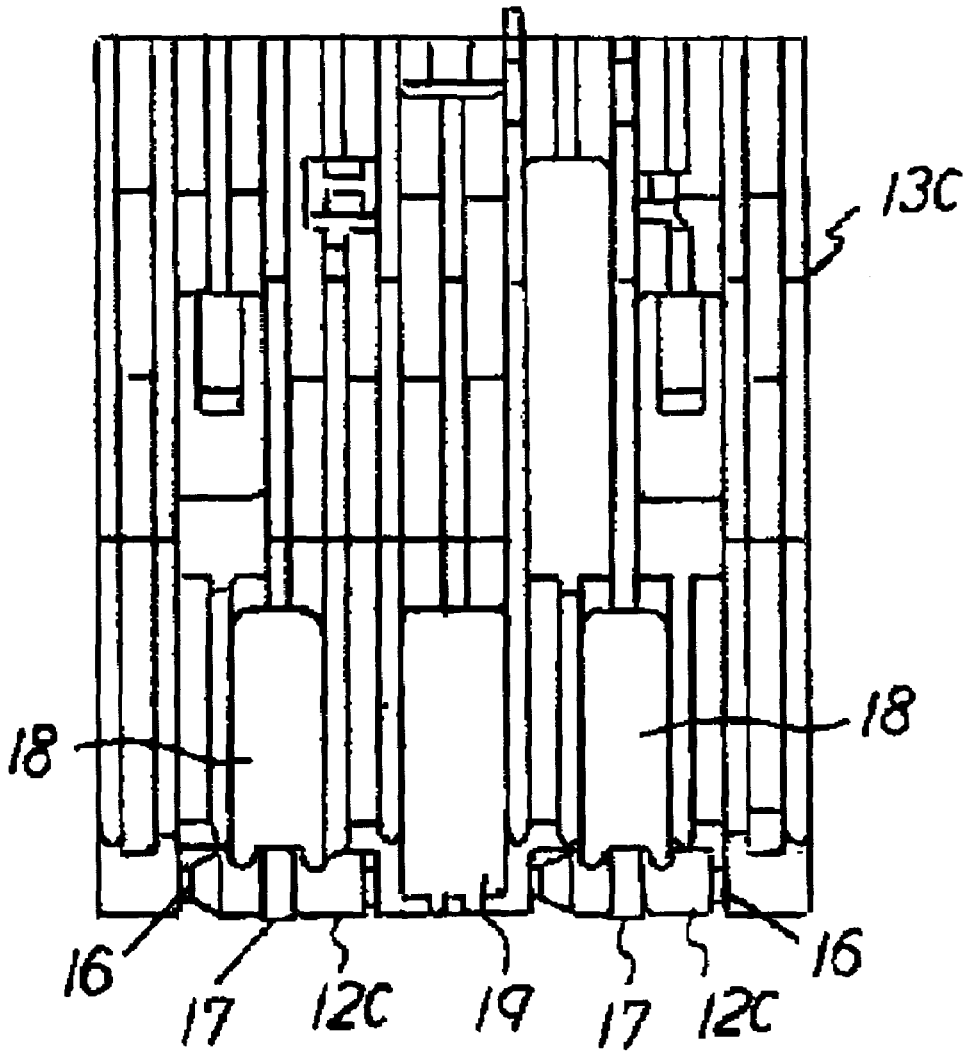
FIG. 4 is a bottom plan view of the roller holder.

As shown in FIG. 4, a guide film 18 for guiding the sheets P near the nip portion between the feed roller 11 and the pinch roller 12C from an upstream of the pinch roller 12C in the sheet feeding direction, is attached to a bottom of the central roller holder 13C at a position near each central pinch roller 12C but out of contact with the elastic ring 17 fitted over the pinch roller 12C. Disposed between the guide films 18 is another guide film 19 that functions similar to the guide films 18. The guide film 19 will be described in more detail below.

Figure 9:
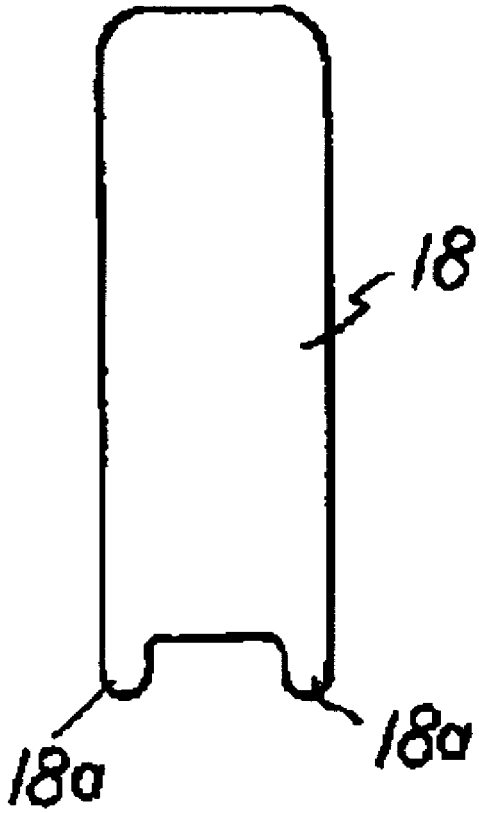
FIG. 9 is a plan view of a guide film.

As shown in FIG. 9, the guide film 18 is formed with a pair of protrusions 18*a* that extend from right and left downstream ends in the sheet feeding direction to a position near the nip portion between the feed roller 11 and the pinch roller 12C, while placing the elastic ring 17 between the protrusions 18, to guide the sheets P. The protrusions 18*a* are formed such that the end of the protrusions 18*a* is positioned on the upstream side in the sheet feeding direction, with respect to a center of the pinch roller 12C (center of the nip portion in the sheet feeding direction), so as to overlap the pinch roller 12C.

In the thus-structured sheet conveying device 10, the roller holder 13 is urged by the spring 15, as described above with reference to FIG. 1. Accordingly, the pinch roller 12 is pressed against the feed roller 11 at a certain pressure.

The sheet P fed by the pick-up roller 3 along the guide 6 is held at the nip portion between the feed roller 11 and the pinch roller 12 and fed in the slanting downward direction to the printing unit 20 where the printing is performed onto the sheet P with the print head 21.

Figure 10:
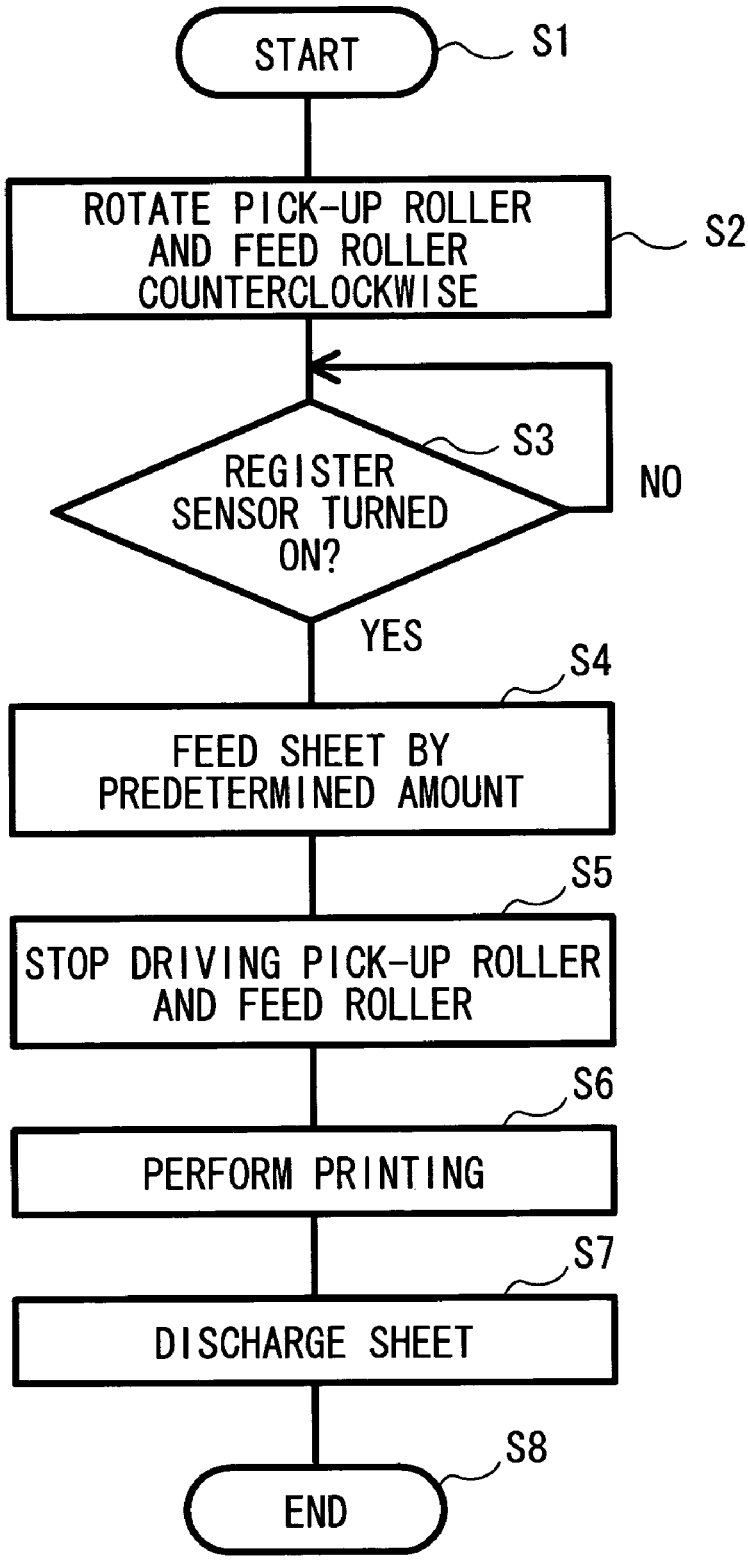
FIG. 10 is a flowchart showing a sheet conveying operation performed for printing.

A sheet conveying operation performed for printing by the printer 1 will be described with reference to FIG. 10.

When the operation is started (S1), the pick-up roller 3 and the feed roller 11 are rotated counterclockwise (S2). Accordingly, a sheet P is picked up from the sheet feeder 2 by the pick-up roller 3 and fed toward the sheet conveying device 10. Then, it is determined whether a register sensor (not shown) disposed upstream of the feed roller 11 in the sheet feeding direction is turned on as the sheet P passes by the register sensor (S3). When it is determined that the register sensor is turned on (S3: YES), the sheet P is further fed by a predetermined amount to correct the diagonal positioning or alignment of the sheet P (S4). At this time, the feed roller 11 and the pinch roller 12 are reversely rotated, and register the sheet P. As an edge of the sheet P is received between the feed roller 11 and the pinch roller, reverse rotation of the pick-up roller 3 and the feed roller 11 is stopped. Thus, the correction of the diagonal positioning or alignment of the sheet P completes (S5).

As the diagonal positioning or alignment of the sheet P is corrected, the feed roller 11 is rotated in the forward direction (clockwise direction). The sheet P is held between the feed roller 11 and the pinch roller 12 and conveyed to the printing unit 20. A predetermined image is formed on the sheet P with the print head 21 of the printing unit 20 (S6).

As the printing operation is finished, the sheet P is discharged while being held between the discharge roller 24 and the presser roller 25 (S7). Thus, the sheet conveying and printing operations are finished (S8).

In FIG. 2, dot-dash line P1 represents the width of the A4 size sheet. Dot-dash line P2 represents the width of a postcard. As shown in FIG. 2, the roller holder 13 is divided in the direction of the sheet width, into a plurality of portions (13L, 13C, 13C, 13R), according to the sizes of the sheets P to be used for printing.

In the sheet conveying device 10, the elastic ring 17 is fitted over the outer surface of each of four pinch rollers 12C, which are rotatably supported in two roller holders 13C disposed between the left and right roller holders 13L, 13R. The elastic deformation of the elastic ring 17 reduces or absorbs load (impact) that causes the rear end of the sheet P to flick or spring and the improper sheet feeding, when the rear end of the sheet P passes through the nip portion between the feed roller 11 and the pinch roller 12. Consequently, variances in the sheet feeding amounts and the poor image formation are prevented.

The projection Δ, as shown in FIG. 7, of the elastic ring 17 from the outer surface of the pinch roller 12C is set to approximately 0.2 mm to 0.5 mm, as described above. Therefore, 0.2 mm to 0.5 mm is ensured as a deformable range of the elastic ring 17. Consequently, the elastic ring 17 elastically deforms by an amount, within the range, enough to reduce or absorb the load (impact) that causes the rear end of the sheet P to flick or spring when the rear end of the sheet P passes through the nip portion between the feed roller 11 and the pinch roller 12.

As the elastic ring 17 is pressed by the feed roller 11, the elastic ring 17 stretches out. The stretch of the ring 17 is absorbed in the clearances δ1, δ2 shown in FIG. 7 between an end of the groove 12*a* of the pinch roller 12 and an end of the elastic ring 17. With this structure, the elastic ring 17 does not extend beyond the edge of the groove 12*a*. Accordingly, occurrences of skew of the sheet are prevented. When the sheet registration operation is performed in which the feed roller 11 and the pinch roller 12C are reversely rotated before the sheet P is fed to the printing unit 20, the leading edge of the sheet P contacts the elastic ring 17 fitted over each of four pinch roller 12C, at the nip portion between the feed roller 11 and the pinch roller 12C, where the positioning of the sheet P is corrected.

In the above-described embodiment, the guide film 18 for guiding the sheets P near the nip portion between the feed roller 11 and the pinch roller 12C, is attached to a bottom of the central roller holder 13C at a position near each central pinch roller 12C but out of contact with the elastic ring 17 fitted over the pinch roller 12C. The leading end of the sheet P may be raised or lifted, due to the factors attributable to the elastic ring 17 and the pinch roller 12, such that the elastic ring 17 is fitted over the pinch roller 12C to project some distance from the outer surface of the pinch roller 12C, has a relatively high friction coefficient of 0.6, and is elastically deformable, as well as that the pinch roller 12 has a relatively small diameter. When the leading end of the sheet P is raised, the leading end of the sheet P may be turned up as the elastic ring 17 is reversely rotated. The end of the sheet P turned up may go off a sheet feeding path or be folded, resulting in improper sheet feeding. With the guide film 18, the sheet P is guided by the guide film 18 near the nip portion between the rollers 11, 12, while preventing the leading end of the sheet P from contacting the elastic ring 17 in the condition such that the end of the sheet P is being lifted or is to be turned up. Accordingly, when the rollers 11, 12 are reversely rotated during the sheet registration, the leading end of the sheet P is prevented from being turned up by the elastic ring 17. The another guide film 19 is disposed at a position in the width direction of the sheet P where the pinch rollers 12C are not disposed, and between the guide films 18. The end of the guide film 19 extends farther from the end of the guide film 18 toward the downstream side in the sheet feeding direction. With the guide films 18 and another guide film 19 functioning similar to the film 18, the sheet P is properly conveyed.

The printer 1 according to the embodiment adopts a "center register" system that takes a center line as a reference for feeding the sheet P. Regardless of the sheet sizes, every sheet P passes the central portion of a sheet feeding path in the width direction thereof. Therefore, flicking of the sheet P or the improper sheet feeding caused by the application of the load (impact) to the rear end of the sheet P can be prevented by fitting the elastic rings 17 over the central pinch rollers 12C provided for the central roller holders 13C. Thus, variances in the sheet feeding amounts can be minimized for every sheet P and consequently, the poor image formation can be prevented. If the number of the roller holder 13 employed is three, that is, left, right, and central roller holders 13L, 13R, 13C, the elastic ring 17 may be fitted over each of two central pinch roller 12C provided for the central roller holder 13C.

Figure 11:
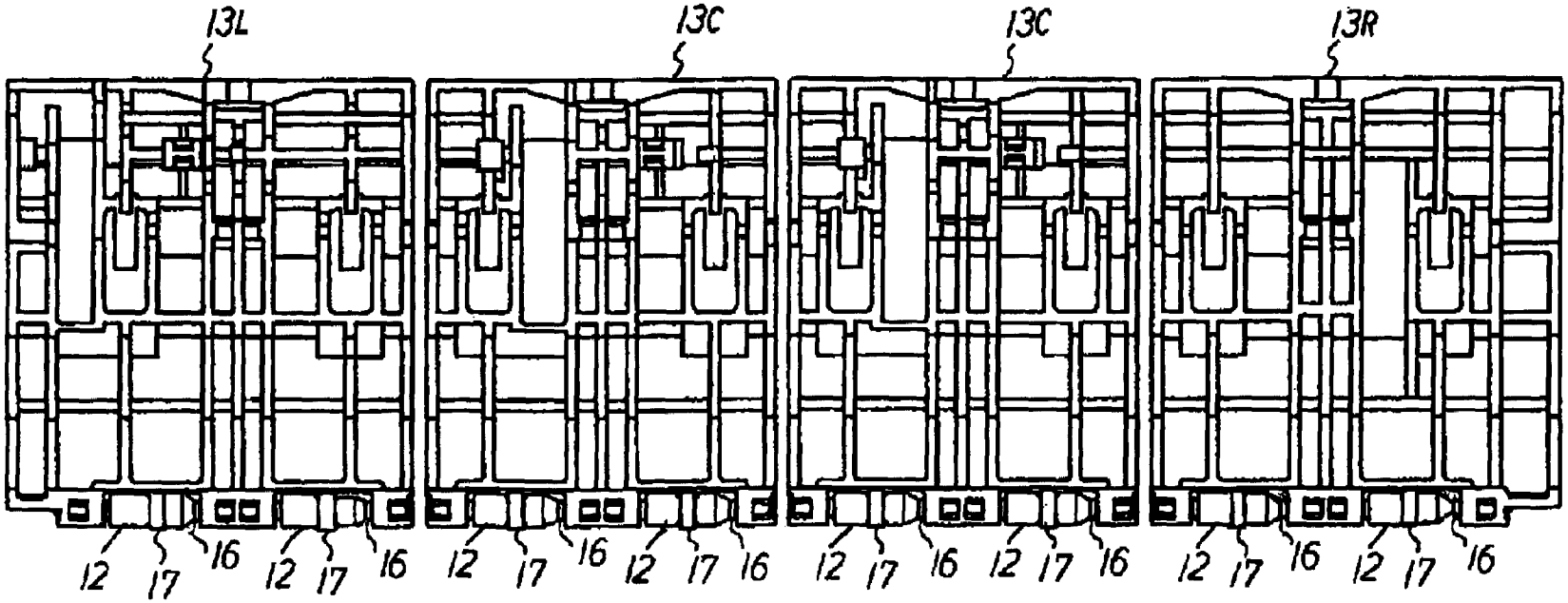
FIG. 11 is a plan view of a roller holder according to a modification of the embodiment of the invention.

Even in printers that do not adopt the "center register" system, the elastic ring 17 may be fitted over every pinch roller 12, as shown in FIG. 11. With this structure, variances in the sheet feeding amounts can be minimized for every sheet P, regardless of the sheet sizes, and consequently, the poor image formation can be prevented. For printers including the feed roller 11 and the pinch roller 12 that are not reversely rotated for the sheet registration, the elastic ring 17 may be fitted over every pinch roller 12. For printers including the feed roller 11 and the pinch roller 12 that are reversely rotated for the sheet registration, the elastic rings 17 may be fitted preferably only over the pinch rollers that are disposed in the substantially central portion of the roller holder, to prevent the sheet from being improperly positioned during the sheet registration, and from being turned up, as well as to reduce costs.

In the sheet conveying device 10, the sheet P is held between the metal feed roller 11 driven by a drive source and the plastic pinch roller 12 pressed against the feed roller 11, and conveyed to the print head 21. The elastic ring 17 having a high wear resistance is fitted over a part of the outer surface of the pinch roller 12 in the width direction thereof. Accordingly, the elastic deformation of the elastic ring 17 fitted over the pinch roller 12 reduces or absorbs load (impact) that causes the rear end of the sheet P to flick or spring and the improper sheet feeding, when the rear end of the sheet P passes through the nip portion between the feed roller 11 and the pinch roller 12. Thus, variances in the sheet feeding amounts and the poor image formation are prevented.

When the feed roller 11 and the pinch roller 12 are reversely rotated during the sheet registration, the leading end of the sheet P is prevented from contacting the elastic ring 17 with the leading end being lifted, and the sheet P is favorably conveyed near the nip portion between the rollers 11, 12, with the guide films 18, 19.

While the invention has been described with reference to the embodiment, it is to be understood that the invention is not restricted to the particular forms shown in the foregoing exemplary embodiment. Various modifications and alterations can be made thereto without departing from the scope of the invention, as set forth in the appended claims.

For example, the elastic ring 17 may be fitted over the pinch roller 11, as well as the feed roller 12, though the elastic ring 17 is only fitted over the pinch roller 12 in the above-described embodiment.

In the above-described embodiment, one elastic ring 17 is fitted over one pinch roller 12C. However, a plurality of the elastic rings 17 may be fitted over one pinch roller 12C.

The guide films 18, 19 are separately disposed on the roller holder 13. However, the guide films 18, 19 formed integrally with a downstream end thereof being separated into a plurality of parts, may be disposed on the roller holder 13.

What is claimed is:

1. A sheet conveying device, for use in an image forming apparatus, that holds a sheet and conveys the sheet to a recording unit, comprising:

a pair of rollers that includes a feed roller driven by a drive source and a pinch roller pressed against the feed roller;

an elastic ring that is fitted over at least one of the feed roller and the pinch roller, in a width direction, on an outer surface thereof;

a guide film that guides the sheet, the guide film extending from an upstream of the pair of rollers in a sheet conveying direction toward a nip portion between the pinch roller and the feed roller, without contacting the elastic ring fitted over the at least one of the pair of rollers; and wherein the at least one of the feed roller and the pinch roller over which the elastic ring is fitted, has, at least at an end thereof, a tapered surface that is gradually narrowed down toward an axial direction.

2. The sheet conveying device according to claim 1, further comprising a roller holder that rotatably supports the pinch roller at an end thereof, the roller holder being movable to allow a pressing condition between the pinch roller and the feed roller to be adjusted, wherein the elastic ring is fitted over the pinch roller in the width direction on the outer surface thereof, and the guide film is mounted on the roller holder and extends from the upstream of the pinch roller in the sheet conveying direction toward the nip portion between the pinch roller and the feed roller, without contacting the elastic ring.

3. The sheet conveying device according to claim 2, wherein the feed roller is made of metal, the pinch roller is made of resin, and the elastic ring is made of thermoplastic fluororubber.

4. The sheet conveying device according to claim 1, wherein a width of the elastic ring is approximately 1 mm to 2.5 mm.

5. The sheet conveying device according to claim 2, wherein average friction coefficient on a total surface of the at least one of the feed roller and the pinch roller over which the elastic ring is fitted, is approximately between 0.4 and 0.47.

6. The sheet conveying device according to claim 1, wherein projection of the elastic ring from the outer surface of the at least one of the feed roller and the pinch roller over which the elastic ring is fitted, is approximately between 0.2 and 0.5 mm in a diametric direction.

7. The sheet conveying device according to claim 1, wherein the at least one of the feed roller and the pinch roller has a groove formed on the outer surface thereof and the elastic ring is fixedly fitted into the groove.

8. The sheet conveying device according to claim 7, wherein the groove is greater than the elastic ring, with respect to width.

9. The sheet conveying device according to claim 2, wherein the pinch roller is divided, in a sheet width direction, into a plurality of rollers, each of the rollers are independently and rotatably disposed on the roller holder, and the elastic ring is fitted over a part of the rollers disposed on a substantially center of the roller holder in the sheet width direction.

10. The sheet conveying device according to claim 1, wherein the guide film has ends protruding toward the sheet feeding direction, the elastic ring is disposed between the protruding ends without contacting the elastic ring, and the protruding ends are located at an upstream side in the sheet conveying direction with respect to a center of the nip portion between the pair of rollers so as to overlap the pair of rollers.

11. The sheet conveying device according to claim 9, wherein the guide film includes a plurality of first guides that are independently provided for the pinch roller over which the elastic ring is fitted, each of the first guides has ends protruding toward the sheet feeding direction, the elastic ring is disposed between the protruding ends without contacting the elastic ring, and the protruding ends are located at an upstream side in the sheet conveying direction with respect to a center of the nip portion between the pair of rollers so as to overlap the pinch roller.

12. The sheet conveying device according to claim 11, wherein the guide film includes a second guide that is disposed between adjacent first guides in the sheet width direction, the second guide is disposed at a position where the pinch roller is not disposed in the sheet width direction, and an end of the second guide extends farther from the ends of the first guides toward a downstream side in the sheet conveying direction.

13. The sheet conveying device according to claim 9, wherein the roller holder is divided, in the sheet width direction, into a plurality of holder parts that are independently movable, and the elastic ring is fitted over the pinch roller rotatably supported in a substantially central holder part in the sheet width direction.

14. The sheet conveying device according to claim 3, wherein the feed roller has a ceramic coating on a metal outer surface.

* * * * *